US007192288B2

(12) United States Patent
Tanaka et al.

(10) Patent No.: US 7,192,288 B2
(45) Date of Patent: Mar. 20, 2007

(54) PORTABLE TERMINAL FOR VEHICLE MOUNTED COMPUTER

(75) Inventors: Hiroyasu Tanaka, Fuji (JP); Toshiji Iida, Fuji (JP); Miki Kinoshita, Fuji (JP); Takashi Eguchi, Fuji (JP)

(73) Assignee: JATCO Ltd, Fuji (JP)

( * ) Notice: Subject to any disclaimer, the term of this patent is extended or adjusted under 35 U.S.C. 154(b) by 189 days.

(21) Appl. No.: 10/970,720

(22) Filed: Oct. 22, 2004

(65) Prior Publication Data

US 2005/0112914 A1 May 26, 2005

(30) Foreign Application Priority Data

Oct. 24, 2003 (JP) ..... 2003-364929

(51) Int. Cl.
*H01R 12/00* (2006.01)

(52) U.S. Cl. ..... 439/76.1

(58) Field of Classification Search ..... 439/76.2, 439/76.1, 689; 174/522, 72 A; 361/815, 361/686

See application file for complete search history.

(56) References Cited

U.S. PATENT DOCUMENTS 3,004,170 A * 10/1961 Greenspan ..... 307/10.5
5,121,289 A * 6/1992 Gagliardi ..... 361/679
5,376,757 A * 12/1994 Marsh et al. ..... 174/72 A
6,885,199 B2 * 4/2005 Desmier et al. ..... 324/663
6,991,475 B2 * 1/2006 Dreyer et al. ..... 439/76.1

FOREIGN PATENT DOCUMENTS

DE 010207762 A1 * 4/2003
JP 10-55464 A 2/1998

* cited by examiner

*Primary Examiner*—Alexander Gilman
(74) *Attorney, Agent, or Firm*—Foley & Lardner LLP

(57) ABSTRACT

A vehicle information collection device that is disposed in a compartment of a vehicle and collects vehicle information, comprising a cylindrical case (1), a connector (8) that is provided at one end of the case (1), for connection to the vehicle mounted computer (200), a main body (2) disposed inside the case (1), that transmits and receives a signal via the connector (8), and a lid (4) that closes the other end of the case (1). With this construction, the device can be easily disposed in the vehicle compartment.

12 Claims, 7 Drawing Sheets

PORTABLE TERMINAL FOR VEHICLE MOUNTED COMPUTER

FIELD OF THE INVENTION

This invention relates to a portable terminal that performs communications with a vehicle mounted computer.

BACKGROUND OF THE INVENTION

JP 10-55464 A issued in 1998 by the Japan Patent Office discloses a device that records data indicating the operating condition of a vehicle in an external storage medium.

SUMMARY OF THE INVENTION

In use, the device is disposed near the driver's seat. However, no dedicated space for installing the device is provided. Therefore, the device takes up space near the driver's seat. When the device is provided on a dashboard, the device may move while the vehicle is running, and disturb the driving operation, or contact and damage the components near the device.

It is therefore an object of this invention to provide a portable terminal which does not take up space in a compartment of a vehicle, and which is firmly positioned even while the vehicle is running.

In order to achieve the above object, this invention provides a portable terminal that performs communications with a vehicle mounted computer, comprising; a cylindrical case; a connector that is provided at one end of the case, for connection to the vehicle mounted computer; a main body disposed inside the case, that transmits and receives a signal via the connector; and a lid that closes the other end of the case.

The details as well as other features and advantages of this invention are set forth in the remainder of the specification and are shown in the accompanying drawings.

DESCRIPTION OF THE PREFERRED EMBODIMENTS

Figure 1:
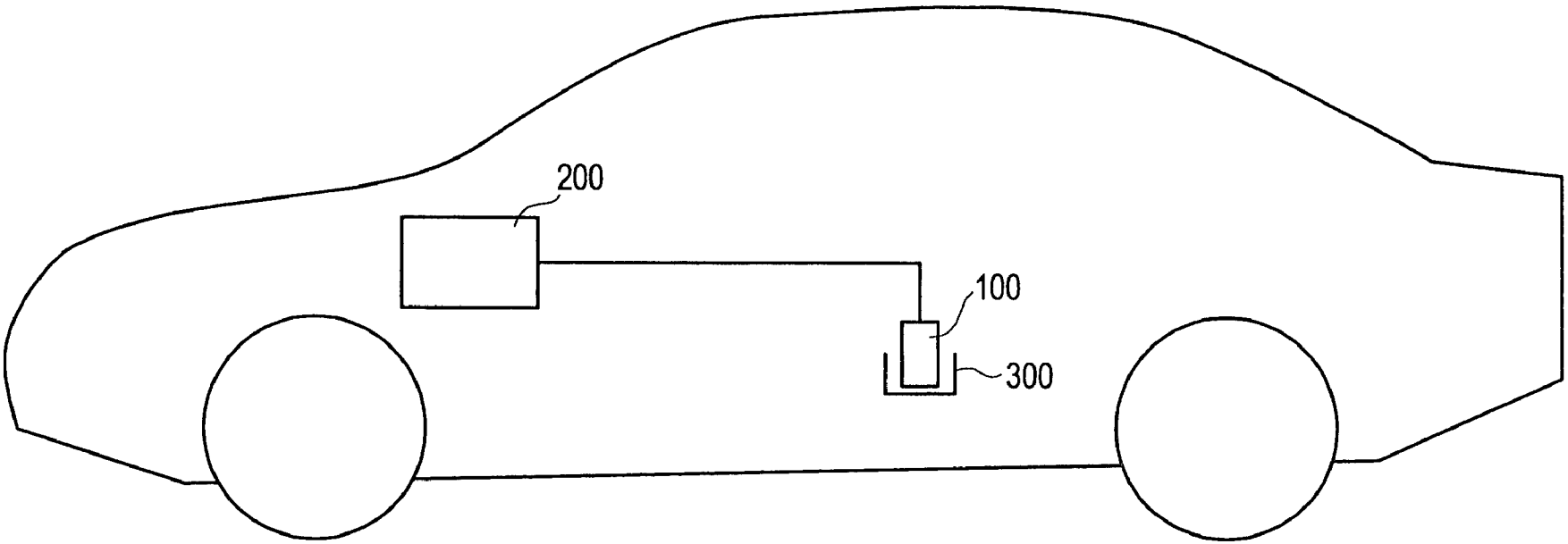
FIG. 1 schematically shows a connection between a portable terminal according to an embodiment of this invention, which is received in a drink holder and a vehicle mounted computer.

Referring to FIG. 1, a portable terminal 100 is a portable device that is connected with a vehicle mounted computer 200 and transmits various items of information such as running data through a serial bus system called the "Controller Area Network (CAN)".

Figure 2A:
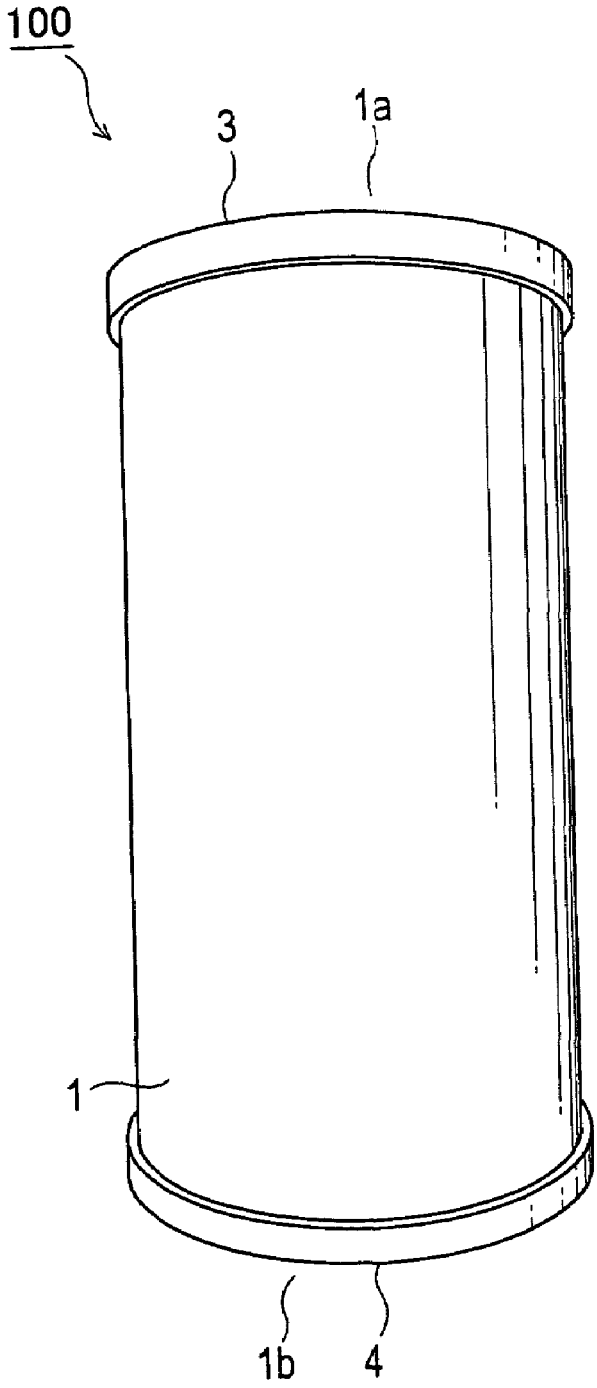
FIGS. 2A and 2B are perspective views of the portable terminal according to an embodiment of this invention.
Figure 2B:
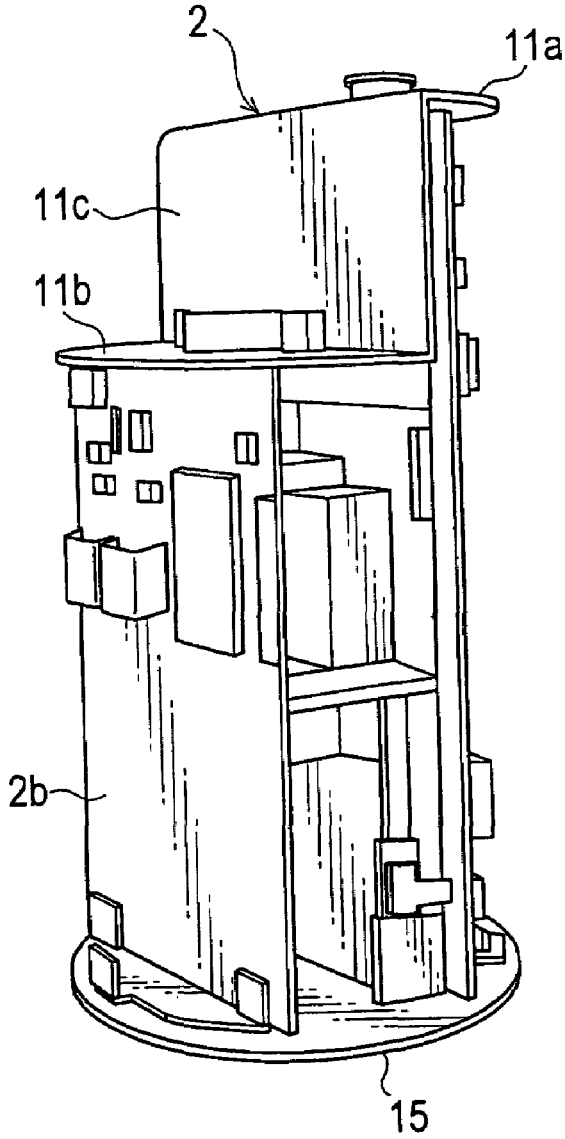

Referring to FIGS. 2A and 2B, the portable terminal includes a cylindrical case 1 and a main body 2 disposed inside the cylindrical case 1. A ring cap 3 is attached to an upper end 1*a* of the cylindrical case 1, and a bottom lid 4 is attached to a lower end 1*b* of the cylindrical case 1.

The outer diameter of the cylindrical case 1 is about 67 mm, which is substantially the same as the outer diameter of normal 350-milliliter beverage cans. The cylindrical case 1 is received by a drink holder installed in a compartment of the vehicle. The cylindrical case 1 is made of an aluminum thin plate. Therefore, the cylindrical case 1 is light, and held easily.

The ring cap 3 is made of rubber, and attached to an outer circumference of the upper end 1*a* of the cylindrical case 1. The ring cap 3 prevents an edge of the upper end 1*a* of the cylindrical case 1 from damaging other members in the compartment. Further, the temperature of the ring cap 3 made of rubber does riot increase in comparison with metal material. Therefore, even when the portable terminal is left in the vehicle, and heated to a high temperature, a person can hold and move the ring cap 3 easily.

The bottom lid 4 closes the lower end 1*b* of the cylindrical case 1. The bottom lid 4 is made of resin material. Therefore, the bottom lid 4 does not damage other members in the compartment of the vehicle. Heavy material with high density may be used for the bottom lid 4, so the portable terminal has the center of gravity at a low position, and the portable terminal is firmly placed in the compartment of the vehicle.

The main body 2 comprises a main board 2*a* (seen in FIG. 3) and a sub-board 2*b*. There are provided a central processing unit (CPU), a memory, and a power unit on those boards. The main board 2*a* and the sub-board 2*b* are provided in parallel with each other, and vertically upright on a circular lower panel 15. The vertical length of the main board 2*a* is longer than that of the sub-board 2*b*. The vertical length of the main board 2*a* and the vertical length of the sub-board 2*b* depend on the layout of the electronic components of the main body 2. As the main board 2*a* and the sub-board 2*b* get shorter, the position of the center of gravity of the portable terminal becomes lower. Such a portable terminal does not tilt down easily, and is firmly positioned. An upper panel 11 is fixed to an upper end of the main board 2*a* and an upper end of the sub-board 2*b*.

The upper panel 11 includes an upper semicircular surface 11*a* fixed to the main board 2*a*, and a lower semi-circular surface 11*b* fixed to the sub-board 2*b*. The upper end of the main board 2*a* is higher than that of the sub-board 2*b*. Therefore, there is a step between the upper semicircular surface 11*a* and the lower semicircular surface 11*b*. The upper semicircular surface 11*a* and the lower semicircular surface 11*b* are connected by a coupling surface 11*c*.

Figure 3:
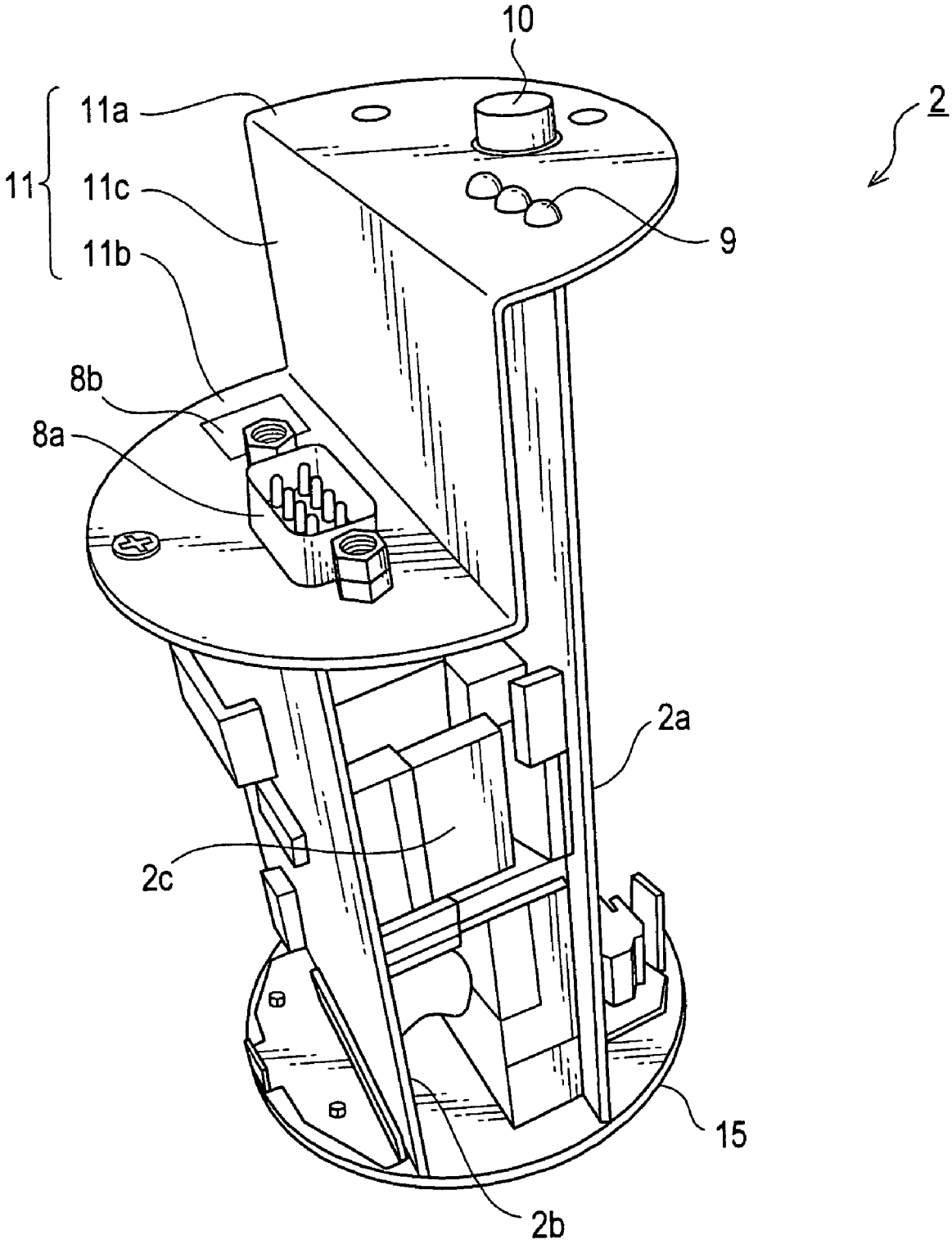
FIG. 3 is a perspective view of a main body of the portable terminal.
Figure 4:
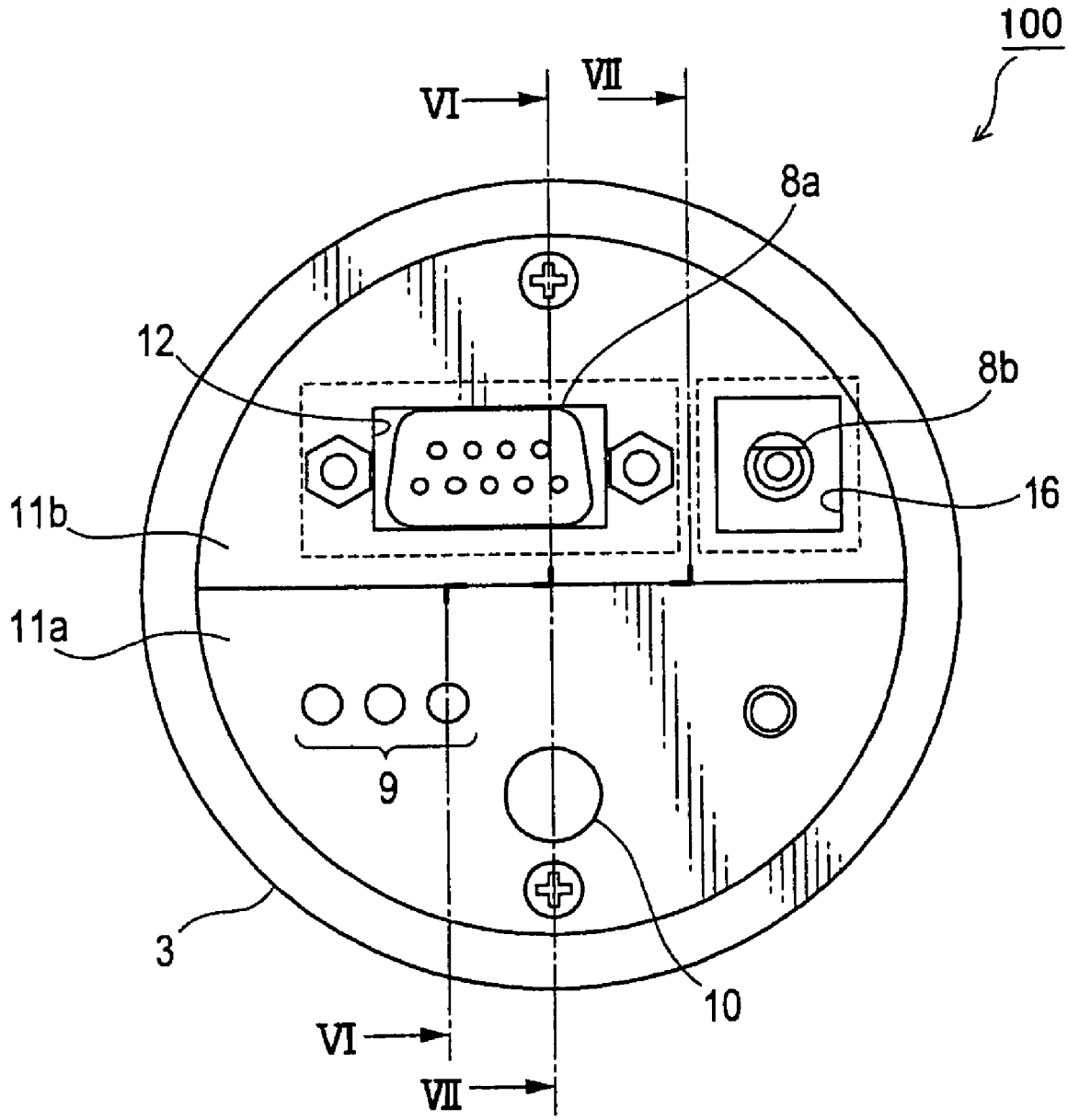
FIG. 4 is a plan view of the portable terminal as viewed from above.

With reference to FIGS. 3 and 4, the main body 2 will be described further in detail.

The main board 2*a* and the sub-board 2*b* are interconnected by a connector board 2*c* to form an electric circuit and a signal circuit.

LEDs 9 indicating the operating condition of the portable terminal are arranged on the upper semicircular surface 11*a* of the upper panel 11. The LEDs 9 have different colors, and the number of LEDs 9 is three. The LEDs 9 report the operating condition to a driver or a user of the portable terminal. Preferably, the relationship between the lighting patterns of the LEDs 9 and the operating condition of the portable terminal can be marked on the outer circumferential surface of the cylindrical case 1.

A push switch 10 is provided on the upper semicircular surface 11*a*. The push switch 10 is manipulated by the driver or the user of the portable terminal. When the push switch 10 is pressed, the main body 2 starts recording signal information inputted from the CAN of the vehicle.

A connector 8*a* for connection to the CAN of the vehicle is provided on the lower semicircular surface 11*b* of the upper panel 11. The signal from the CAN of the vehicle is inputted into the main body 2 via the connector 8*a*. Further, a terminal 8*b* that obtains electricity from a cigar lighter socket of the vehicle is provided on the lower semicircular surface 11*b*.

It is preferable to provide the connector 8*a* and the terminal 8*b* on the lower semicircular surface 11*b* for the following reasons.

Figure 6:
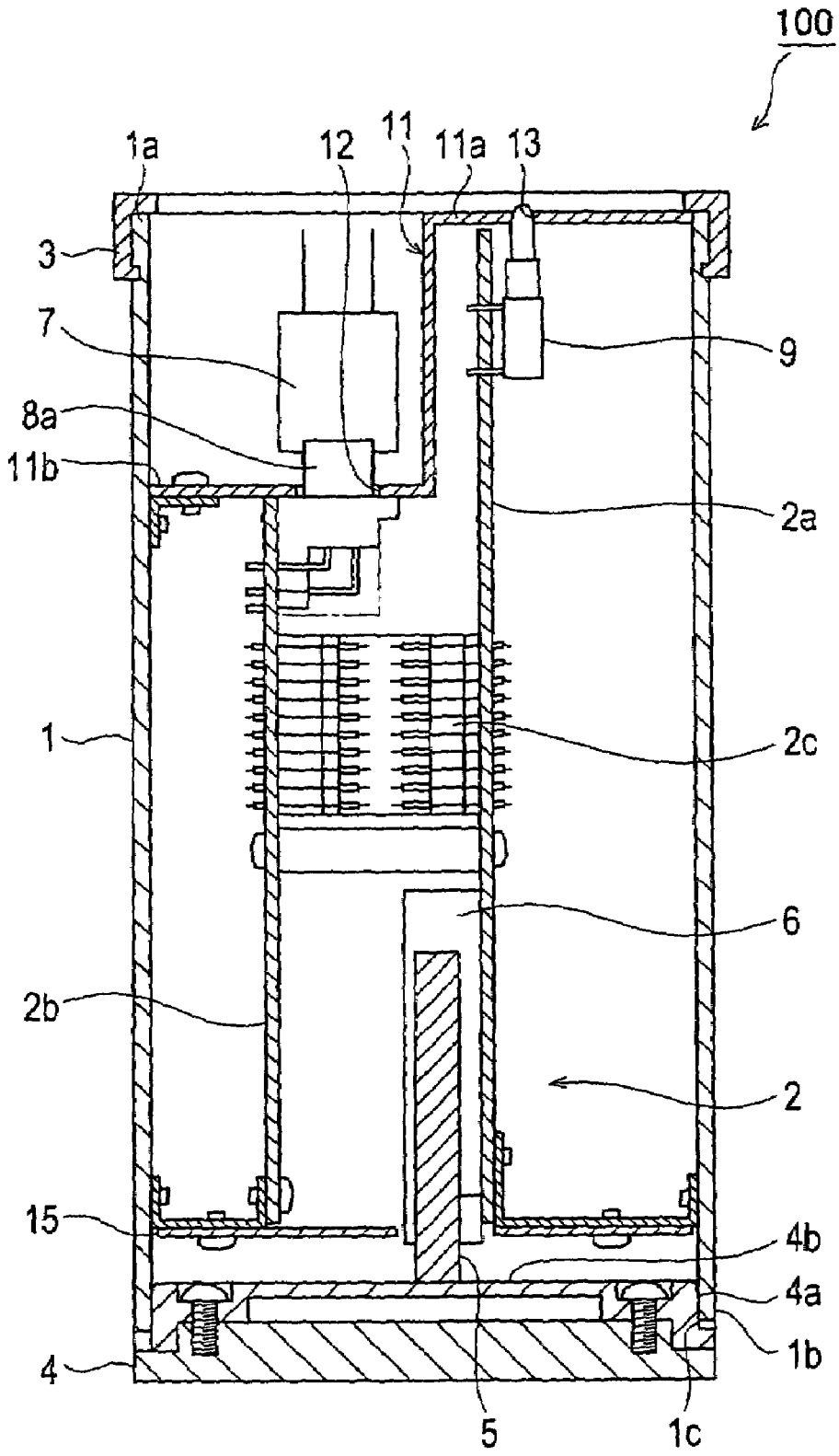
FIG. 6 is a cross sectional view of the portable terminal taken along the line VI—VI in FIG. 4.

Referring to FIG. 6, a connector 7 of a cable connected to the connector 8*a* and a terminal of a power source cable that supplies electricity to the terminal 8*b* are both provided in a recess surrounded by the lower semicircular surface 11*b*, the coupling surface 11*c*, and the inner circumferential surface of the cylindrical case 1, and do not protrude from the cylindrical case 1 upwardly. Therefore, when the portable terminal is used, it is possible to keep the height of the portable terminal substantially at a low level. Further, the structure is helpful to protect the connector 7 and the terminal of the power source cable.

The length of the cylindrical case 1 is determined such that the LEDs 9, the push switch 10, and the connector 7 of the cable connected to the connector 8*a* do not protrude from the cylindrical case 1. With the structure which prevents protrusion of components from the cylindrical case 1, even when the portable terminal tilts down, other members around the portable terminal, or in-vehicle components are not damaged.

Figure 5:
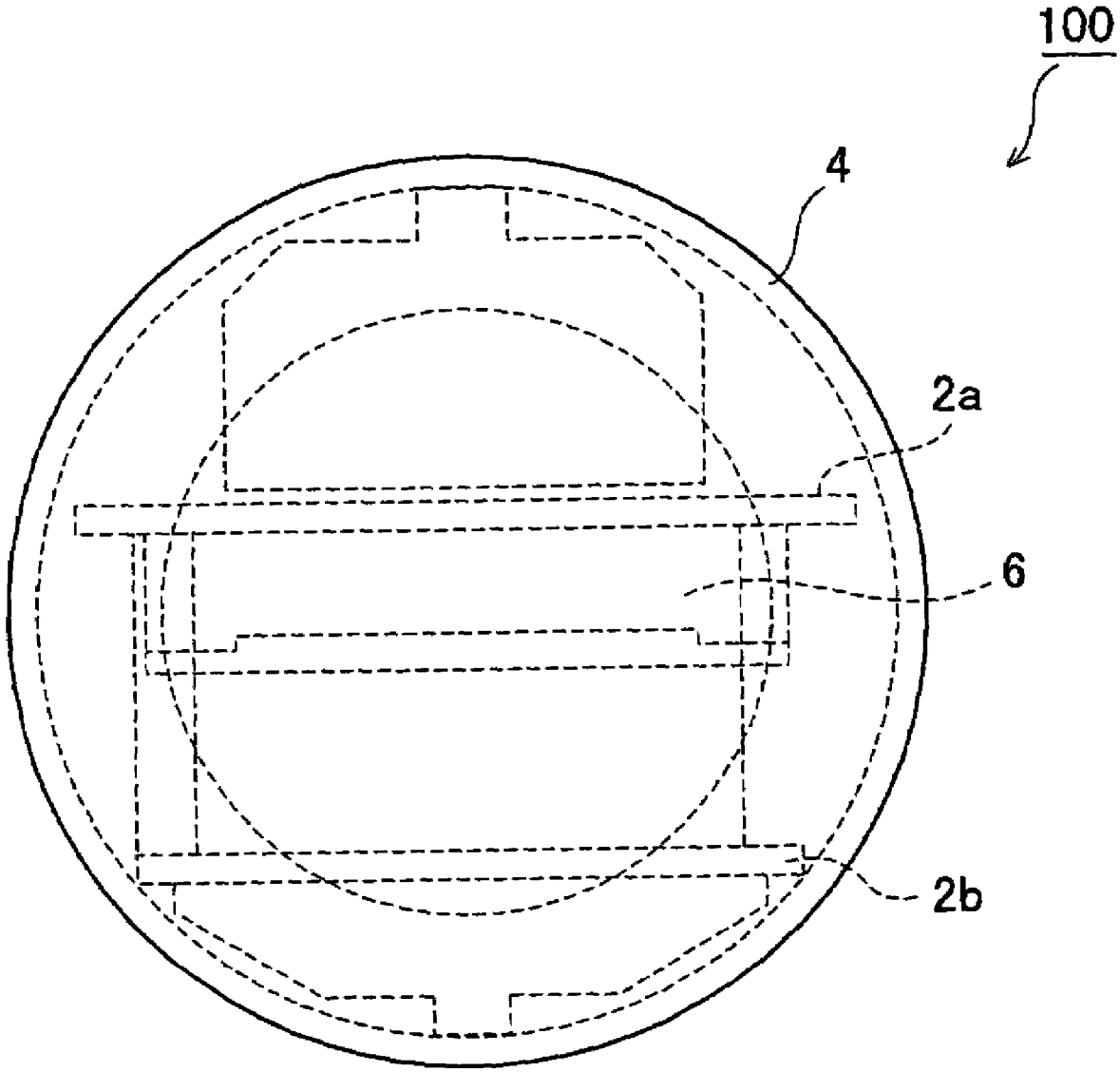
FIG. 5 is a plan view of the portable terminal as viewed from below.

Referring to FIG. 5, the main body 2 includes a slot 6 for inserting a memory card 5 as a detachable storage medium between the main board 2*a* and the sub-board 2*b*. The slot 6 has a connector for connection to the memory card 5.

Figure 7:
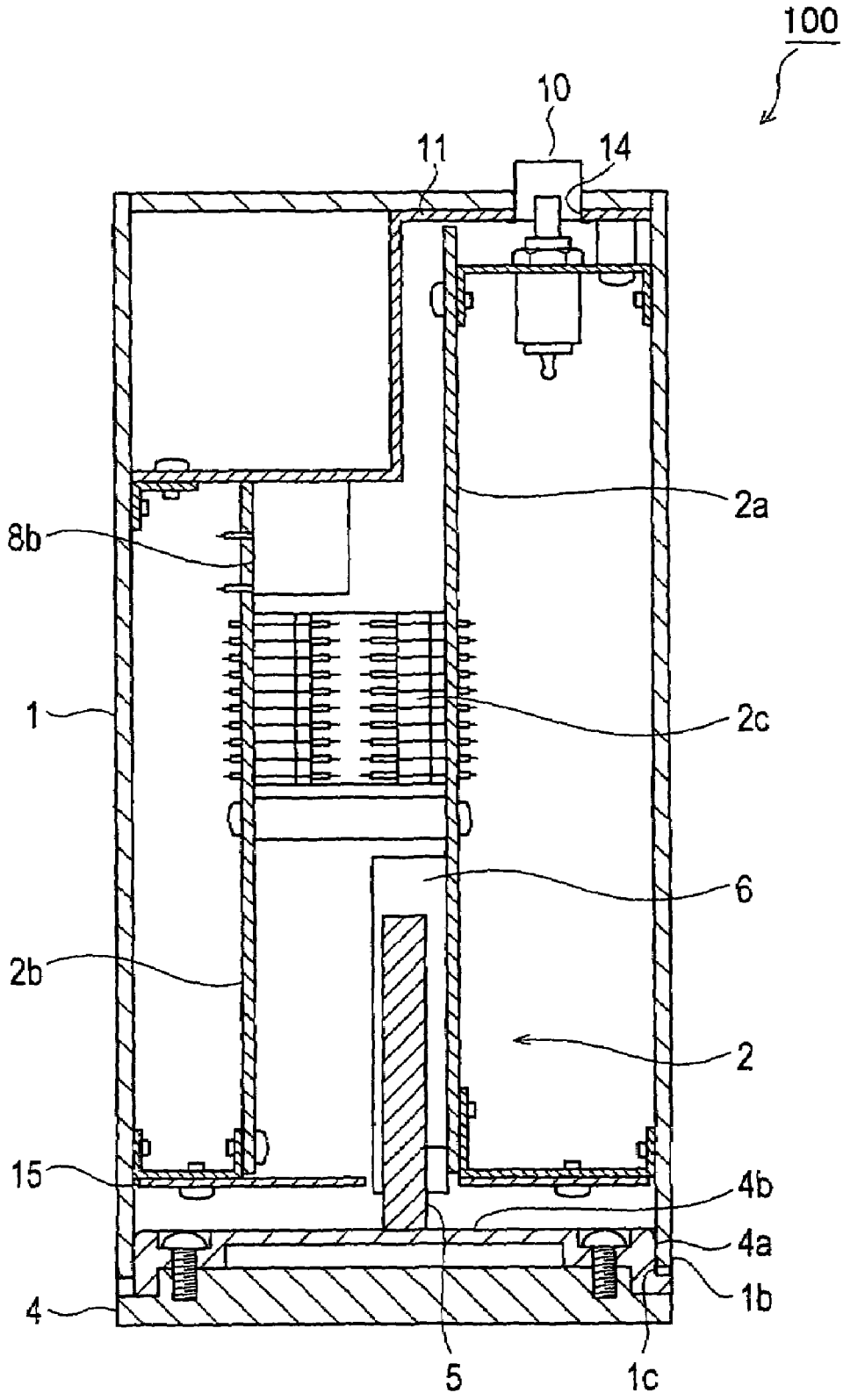
FIG. 7 is a cross sectional view of the portable terminal taken along the line VII—VII in FIG. 4.

Referring to FIGS. 6 and 7, the upper panel 11 and the lower panel 15 are fixed to the cylindrical case 1, respectively. The main board 2*a* and the sub-board 2*b* are fixed to the cylindrical case 1 through the panels 11, 15. Even when the cylindrical case 1 is heated to a high temperature, the heat of the cylindrical case 1 is not transmitted to the two boards 2*a*, 2*b* significantly. Thus, the thermal affect to the electronic components attached to the boards 2*a*, 2*b* is suppressed. Further, since the cylindrical case 1 is hermetically closed by the panels 11, 15, it is possible to prevent the entry of dust into the cylindrical case 1.

A female screw 1*c* is formed in an internal circumferential surface at the lower end of the cylindrical case 1. The bottom lid 4 has a male screw 4*a* screwed into the female screw 1*c*. The male screw 4*a* has a chamfered tip end, so the bottom lid 4 is easily attached to the cylindrical case 1.

In order to reduce the overall height of the portable terminal, the length of the female screw 1*c* and the length of the male screw 4*a* are minimized in so far as the required tightening force by the screws 1*c*, 4*a* is maintained.

Rubber material is attached to a surface 4*b* of the bottom lid 4 which contacts the memory card 5. After the memory card 5 is inserted into the slot 6, the bottom lid 4 is screwed into the cylindrical case 1. The bottom lid 4 screwed into the cylindrical case 1 keeps the memory card 5 inside the slot 6 by the elastic force of the rubber member. This prevents disconnection of the memory card 5 from the connector in the slot 6 due to vibrations while the vehicle is running.

Since the slot 6 is closed by the bottom lid 4 hermetically, it is possible to prevent the entry of dust into the slot 6. The structure of the bottom lid 4 is helpful to prevent contact failure of the memory card 5 and the connector in the slot 6. Further, the slot 6 is provided at a substantially central position in the cylindrical case 1. Therefore, the heat from the cylindrical case 1 is not transmitted to the slot 6 significantly. The desired environment for preventing malfunction of the memory card 5 due to the heat is achieved.

The upper semicircular surface 11 a of the upper panel 11 has holes 13 and a hole 14. The LEDs 9 protrude upward through the holes 3. The push switch 10 passes through the hole 14. The lower semicircular surface 11*b* of the upper panel 11 has a hole 12 and a hole 16 (seen in FIG. 4). The connector 8*a* passes through the hole 12, and the terminal 8*b* passes through the hole 16.

The main body 2 receives the signal from the CAN installed in the vehicle, and records the necessary data in the memory card 5.

The portable terminal having the structure as described above can be set in a drink holder equipped in the compartment of the vehicle. Therefore, the portable terminal does not take up space in the vehicle. Further, the vehicle is firmly held even while the vehicle is running.

The portable terminal according to the above embodiment of the present invention is described as a terminal that collects the vehicle information. However, the present invention is not limited to the embodiment described above, the communications may be achieved between the CPU provided in the main body 2 and the vehicle mounted computer 200.

The contents of Tokugan 2003-364929 with a filing date of Oct. 24, 2003 in Japan are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

What is claimed is:

1. A portable terminal that performs communications with a vehicle mounted computer, comprising:

a cylindrical case;

a connector that is provided at one end of the case, for connection to the vehicle mounted computer;

a main body disposed inside the case, that transmits and receives a signal via the connector;

a lid that closes the other end of the case; and a panel that fixes one end of the main body to the case and on which the connector is provided, wherein the panel includes two semicircular surfaces which are offset in a direction of the central axis of the case, and wherein the connector is formed on one semicircular surface of the two semicircular surfaces which is disposed in the case.

2. The portable terminal as defined in claim 1, wherein the diameter of the case is 67 mm or less.

3. The portable terminal as defined in claim 1, wherein the case is made of aluminum.

4. The portable terminal as defined in claim 1, further comprising a ring cap that is attached to the one end of the case and covers an edge of the case.

5. The portable terminal as defined in claim 1, wherein the connector is disposed in the case and does not protrude from the one end of the case.

6. The portable terminal as defined in claim 1, wherein the lid is screwed into the case so as to be freely detached from the case, and wherein the portable terminal further comprises a detachable storage medium that is inserted into the main body when the lid is removed from the case.

7. The portable terminal as defined in claim 1, wherein the lid is made of resin.

8. The portable terminal as defined in claim 1, further comprising an indicating part that is provided on one semicircular surface of the two semicircular surfaces exposed externally in the direction of the central axis of the case and indicates an operating condition of the main body.

9. The portable terminal as defined in claim 1, further comprising a switch that is provided on one semicircular surface of the two semicircular surfaces exposed externally in the direction of the central axis of the case and issues an instruction to start operation of the main body.

10. The portable terminal as defined in claim 1, wherein the main body includes two boards provided in parallel with each other along the direction of the central axis of the case, an end of one board is fixed to one semicircular surface of the two semicircular surfaces, and an end of the other board is fixed to the other semicircular surface of the two semicircular surfaces.

11. The portable terminal as defined in claim 10, further comprising a slot provided between the two boards, and a detachable storage medium inserted into the slot.

12. The portable terminal as defined in claim 11, further comprising a switch that is provided on one semicircular surface of the two semicircular surfaces exposed externally in the direction of the central axis of the case and issues an instruction to start storing information in the detachable storage medium.

* * * * *